United States Patent [19]

Tsuda

[11] Patent Number: 4,964,942

[45] Date of Patent: Oct. 23, 1990

[54] ADHESIVE TAPE APPLICATOR

[75] Inventor: Masaaki Tsuda, Yokohama, Japan

[73] Assignee: Kabushiki Kaisha Takara, Osaka, Japan

[21] Appl. No.: 343,141

[22] Filed: Apr. 25, 1989

[51] Int. Cl.[5] ..... B31B 1/72; B31B 7/60

[52] U.S. Cl. ..... 156/468; 156/289; 156/486

[58] Field of Search ..... 156/233, 234, 289, 468, 156/486; 53/137

[56] References Cited

U.S. PATENT DOCUMENTS 4,227,955 10/1980 Woods et al. ..... 156/468

4,869,769 9/1989 DiRusso et al. ..... 156/468

*Primary Examiner*—Joye L. Woodard

*Attorney, Agent, or Firm*—Wenderoth, Lind & Ponack

[57] ABSTRACT

An adhesive tape applicator for applying a fraudulent-opening preventive adhesive tape in an "L" form on the corners of a package of medical articles or the like. For easy peeling of the adhesive tape, the apparatus according to the present invention is so arranged that the adhesive tape has superposed on the adhesive side thereof a separate paint foil tape, the adhesive tape and paint foil tape are supplied from their respective sources, the paint foil tape thus superposed on the adhesive tape is stuck by a hammer to transfer a portion thus stuck of the paint foil to the adhesive side of the adhesive tape, thereby forming a non-adhesive lug piece, the adhesive tape having the non-adhesive lug pieces thus formed thereon is fed toward the package carrying path from under the path, the adhesive tape is cut along the boundary between the transferred paint foil and the adhesive area and attached by being pressed by an application roller against the corner of the package.

2 Claims, 4 Drawing Sheets

ADHESIVE TAPE APPLICATOR

BACKGROUND OF THE INVENTION

1. Field of the Invention:

The present invention relates to an adhesive tape applicator destined for applying a fraudulent-opening preventive adhesive tape in an "L" form on the corners of a package of medical articles or the like, and more particularly to an adhesive tape applicator for applying an adhesive tape having a non-adhesive lug piece formed, for easy peeling when used, on the adhesive side thereof by transferring a paint foil onto the adhesive side.

2. Description of the Prior Art:

The conventional adhesive tape for preventing fraudulent opening of a package is attached in an "L" form on the corners resulting from the overlapping of the package flaps and when the package is unsealed and opened, evidence of the unsealing remains on the package.

Generally, various types of adhesive tape applicators have heretofore been proposed which are intended for attaching an adhesive tape in an "L" form on the corners of a package for sealing the latter regardless of the desire to prevent the package from fraudulently being opened. As one of such types of adhesive tape applicators, an apparatus for feeding and cutting tapes is known from the disclosure in, for example, the Japanese Examined Patent Publication No. 52-6795 (Fumiko Tange, Inventor), in which an adhesive tape is simply fed straightly the front of a package and it is attached on the corner of the package as pressed by a compression roller by being the package is moved forward. Most of the proposed apparatus are of this type. Namely, the adhesive tapes of this type have the adhesive on one whole side thereof, and when applied on a package, the tape is attached at the whole area of the adhesive side on the package, which means that the tape cannot easily be peeled off the package. For facilitating the unpacking of a package sealed with such adhesive tape, it has also been proposed to provide a non-adhesive area at one end of the tape for easy peeling.

However, since the formation of such non-adhesive on an adhesive tape is which constitutes such that a lug piece such a separate tape piece or paper piece is attached on a desired portion of the tape to hide the adhesive on that portion, the adhesive tape application is complicated and also since it takes a relatively long time lug-piece application for elimination of any misalignment between the adhesive tape and lug piece, the costs for manufacturing such apparatus are high.

SUMMARY OF THE INVENTION

The present invention has as an object to overcome the above-mentioned drawbacks of the prior-art apparatus by providing a simple adhesive tape applicator which transfers a paint foil onto a portion of an adhesive tape to cover the adhesive on the tape portion, thereby forming an adhesive-free lug piece which makes it easy to peel off the adhesive tape attached on an object or a package.

The above-mentioned object is attained by providing an adhesive tape applicator comprising, according to the present invention, a tape supplying means located below a package carrying path and which guides, to a hammer receiver an adhesive tape intermittently fed from a predetermined adhesive tape roll and a foil tape also stepwisely fed out from a roll of a tape on which a paint foil is printed, with the adhesive tape and the foil superposed a foil pressing means which hits, by means of a camdriven hammer, the tapes guided while superposed one on another on the hammer receiver to transfer the hit portion of the paint foil on the foil tape onto the adhesive side of the adhesive tape, a tape feeding means comprising a vertical feed-out belt and a pinch roller, which operate cooperatively with each other to feed to an opening in the package carrying path the adhesive tape having the paint foil transferred onto a portion thereof by the above-mentioned foil pressing means, a means for cutting the fed tape at the boundary between the paint foil and adhesive on the tape, and a tape application roller disposed movably between a tape application position above the package carrying path and a parking position under the path.

Because of the above-described configuration of the adhesive tape applicator according to the present invention, the adhesive tape and foil tape intermittently supplied are fed while superposed one on another to the hammer receiver where they will be hit from the rear side of the foil tape by the hammer intermittently driven by the cam, the hit portion of the paint foil on the foil tape is thus transferred to the adhesive side of the adhesive tape, the adhesive tape having the paint foil portions thus transferred thereon at predetermined intervals is cut at the beginning of each paint foil portion on the adhesive tape, and moved forward and upwardly through the opening in the package carrying path. At this instant, the adhesive side of the adhesive tape is attached, by being forced by means of the tape application roller and its associated holder, onto the corner of a package moved on the carrying path, while the paint foil or layer, that is, a non-adhesive area serving as a peeling lug piece, leads the top end of the adhesive tape thus attached.

BRIEF DESCRIPTION OF THE DRAWINGS

The accompanying drawings show the embodiment of the present invention.

DETAILED DESCRIPTION OF THE PREFERRED EMBODIMENTS

Figure 1:
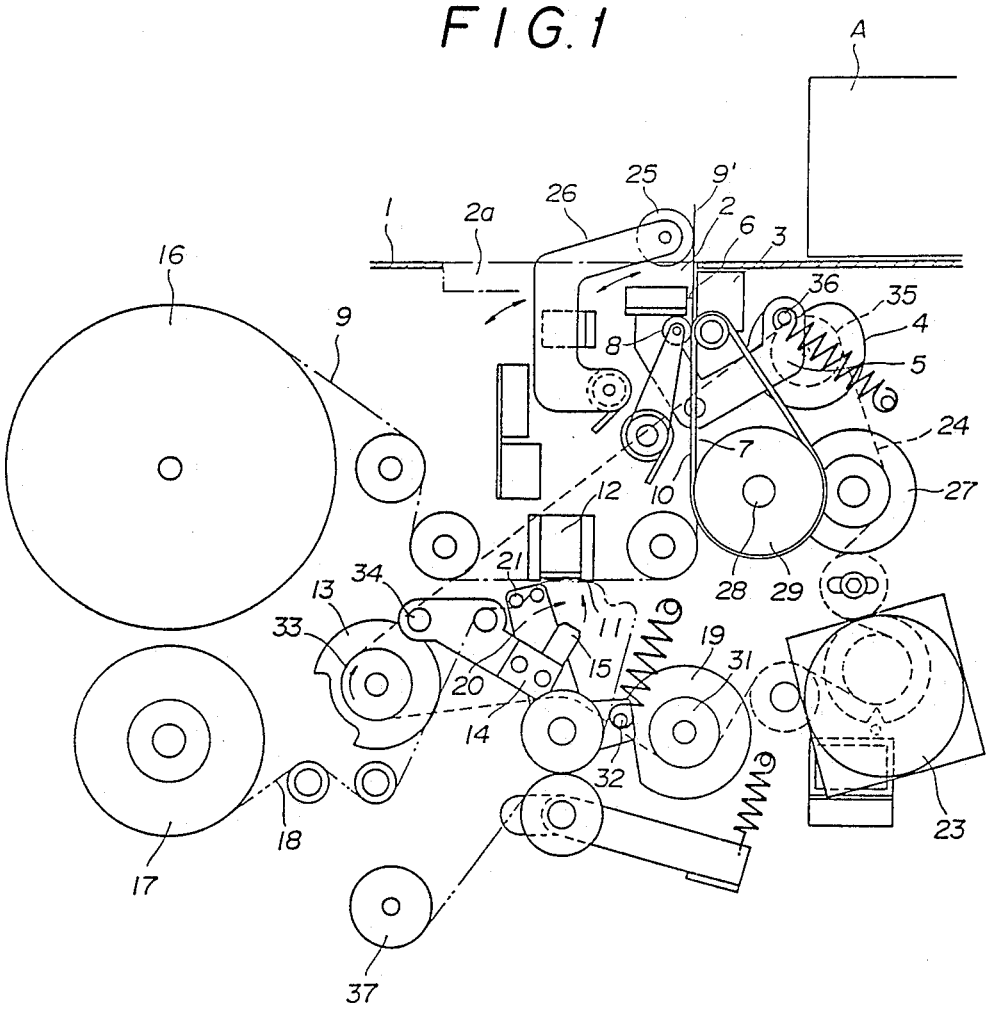
FIG. 1 is a side elevation showing the essential portion of the adhesive tape applicator according to the present invention.
Figure 2:
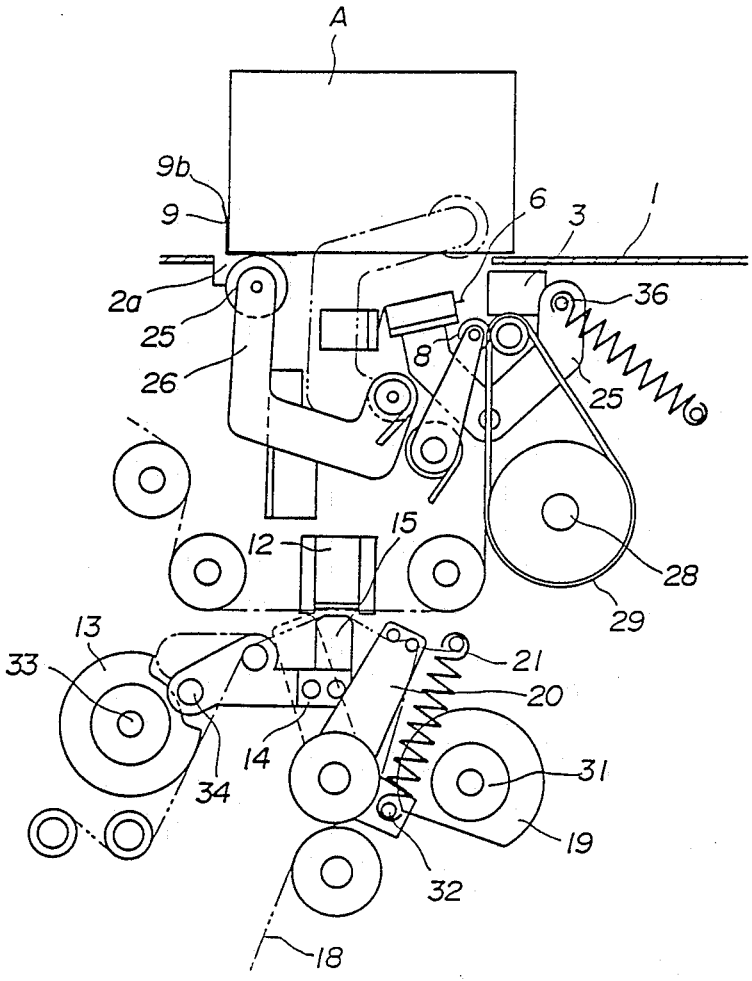
FIG. 2 is a side elevation showing the adhesive tape applicator in operation.
Figure 3:
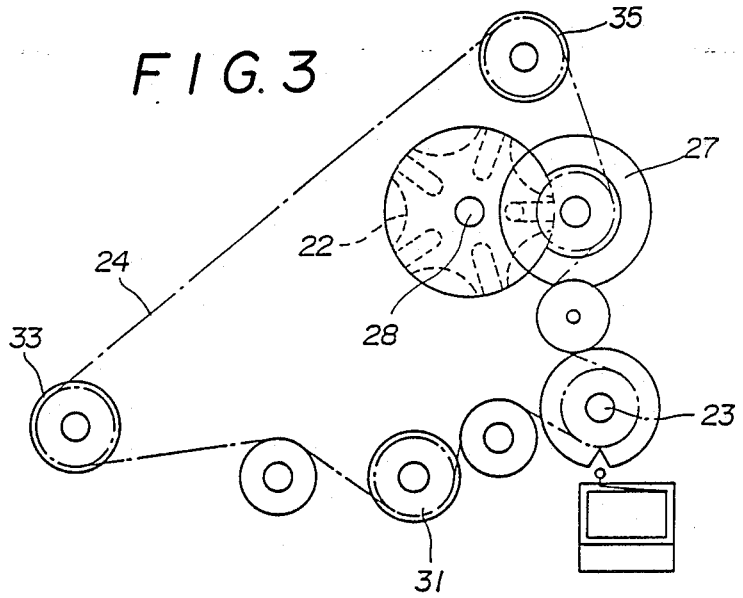
FIG. 3 is a side elevation of the transmission mechanism.
Figure 4:
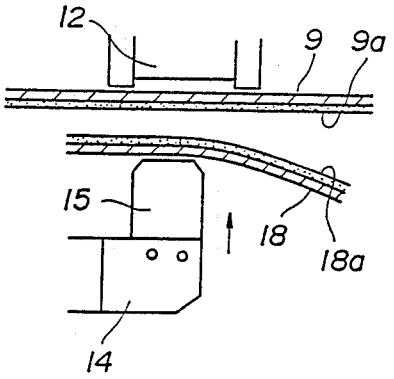
FIGS. 4 and 5 are explanatory drawings, respectively, showing the paint foil being pressed.
Figure 5:
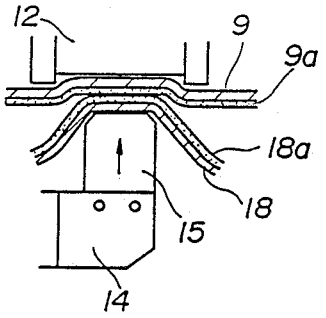
Figure 6:
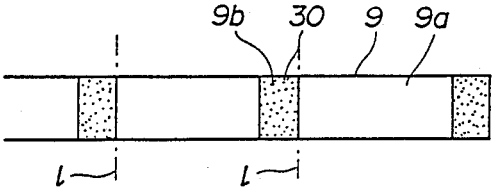
FIG. 6 is a front view of the adhesive tape onto which the paint foil or layer is transferred.
Figure 7:
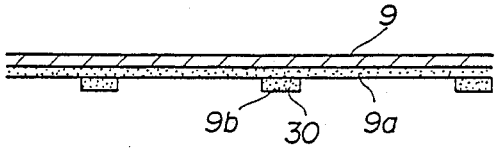
FIG. 7 is a longitudinal sectional view of the tape of FIG. 6.

The embodiments of the present invention will be described in detail below:

The reference numeral 1 indicates a package carrying path on which there is placed a package A containing medical articles or the like and which is moved by a transferring means (not shown) such as a conveyor or the like. The package carrying path 1 has formed therein at the middle thereof an opening 2 through which an adhesive tape is fed out and beneath which a cutting mechanism is provided which has a fixed cutter anvil 3 and a cutter 6 provided on an actuating arm 5 pivotable by a cam 4 and which is forced against the cutter anvil 3 to cut the tape. There is provided beneath the cutter anvil 3 a tape feeding means 10 comprising a vertical tape feed-out belt 7 running upward in the direction toward the tape feed-out opening 3 and a pinch roller 8. The reference numeral 11 indicates a foil pressing means provided below the tape feeding means 10 and which comprises a horizontally fixed hammer anvil 12 and a hammer 15 projecting from the end of an actuating arm 14 interlocked with a cam 13 and which is as wide as at least the adhesive tape or wider than the latter. There is laid on the bottom face of the hammer anvil 12 an adhesive tape 9 led out from an adhesive tape roll 16 with the adhesive side 9*a* directed downward, while a paint foil tape 18 led out from a paint foil tape roll 17 is laid opposite to the adhesive side 9*a* of the adhesive tape 9 and with the paint foil 18*a* thereon directed upward. Namely, the adhesive tape and paint foil tape are superposed one on another at the bottom face of the hammer anvil 12. In this case, the foil tape 9 is moved, being guided by a guide roller 21 operable by being interlocked with the swinging of a feed arm 20 which is driven by another cam 19, to below the above-mentioned adhesive tape 9 at the bottom of the hammer anvil 12. The hammer cam 13, foil tape cam 19 and a Geneva drive 22 for intermittently driving the cutter cam 4 and vertical feed-out belt 7 are operationally coupled to each other by means of an endless chain 24 driven by a motor 23, thus forming together an interlocking mechanism. The reference numeral 25 indicates a tape application roller which is projected out of the opening 2 in the package carrying path 1. This application roller 25 is moved by being driven by a pivotable support arm 26 from a tape application position above the carrying path 1 toward a parking position below the path 1 through a parking opening 2*a* formed in the path 1.

Figure 8:
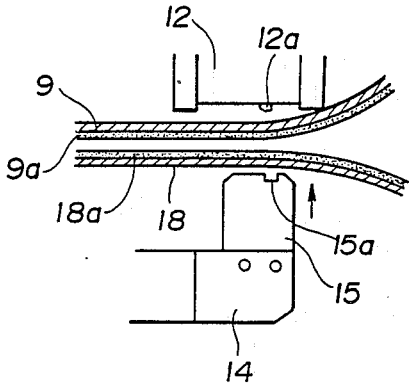
FIG. 8 is a side elevation showing variants of the hammer receiver and hammer, respectively.

FIG. 8 shows variants of the hammer anvil 12 and hammer 15, respectively, in which a recess 15*a* is formed in the one end of the hammer 15 and a protrusion 12*a* is formed on the face of the hammer anvil 12 opposite to the hammer 15, thereby causing the paint foil portion on the adhesive tape A to be deformed outwardly.

The adhesive tape applicator according to the present invention functions as will be described below:

First, when the Geneva drive 22 is intermittently rotated by being driven by an intermittently operable driving wheel 27 which is rotated by means of the chain 24 on the motor 23 and the vertical feed-out belt 7 on a pulley 29 at the end of a shaft 28 of the Geneva drive 22 is stepwise moved, the adhesive tape 9 interposed between the belt 7 and the pinch roller 8 is intermittently carried upward. In this case, the adhesive tape 9 has attached at predetermined intervals on one side thereof, namely, on the adhesive side 9*a*, the non-adhesive areas 9*b* being formed by the paint layer or foil portions 30 which have been pressed on the adhesive tape 9 by the paint foil pressing means 11 located upstream of the tape lead-out mechanism. That is to say, the adhesive tape 9 at the bottom of the hammer anvil 12 is pulled by the vertical feed-out belt 7 while the foil tape 18 led out from the foil tape roll 17 by the guide roller 21 is fed to under the adhesive tape 9 at the hammer anvil 12 as the feed arm 20 formed integrally with a driven member 32 which moves following the displacement of the cam provided coaxially with a sprocket 31 which is rotated by means of the chain 24. On the other hand, the actuating arm 14 of a drive member 34 which follows the displacement of the cam 13 provided coaxially with a sprocket 33 rotated by the chain 24 is rotated to strike the hammer anvil 12 with the hammer 15 provided at the end of the actuating arm 14, thereby pressing the foil tape 18 onto the adhesive tape 9, so that only the paint foil 18*a* on the foil tape 18 in the portion that is pressed by the hammer 15, is transferred as paint layer portion 30 to the adhesive side 9*a* of the adhesive tape 9 on which the foil tape 18 overlaps. Thus, the paint layer portion 30 forms the non-adhesive area 9*b*.

Figure 9:
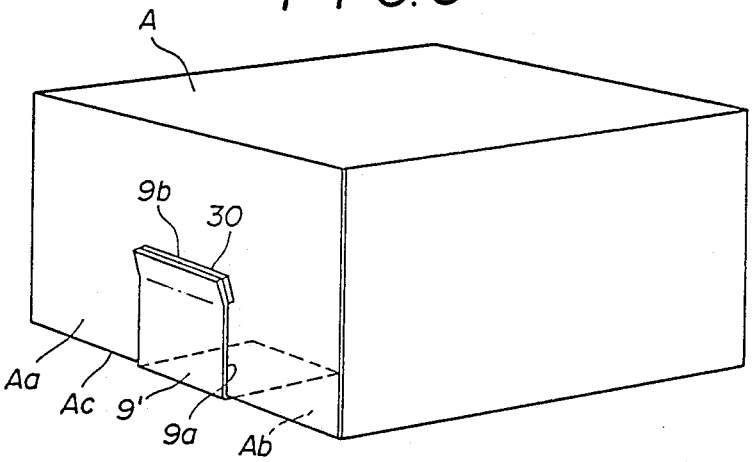
FIG. 9 is a perspective view showing the adhesive tape attached to a package.

In this case, if a protrusion 12*a* is formed on the face of the hammer anvil 12 and a recess 15*a* is provided in one end of the hammer 15 as shown in FIG. 8, the boundary between the non-adhesive area 9*b* and the adhesive side 9*a* of the adhesive tape can be deformed so that the non-adhesive area 9*b* is raised somewhat as shown in FIG. 9 when the tape is attached on a package, thereby facilitating peeling of the tape later at the time of unpacking.

As the adhesive tape 9 having the paint layer portion 30 thus transferred there to is moved by the vertical feed-out belt 7 to the cutting mechanism, a driven member 36 of the actuating arm 5 generally V-shaped as a whole and which follows the displacement of the cam 4 on the sprocket 35 pivoted by the chain 24 is displaced, the actuating arm 5 turns and thus the cutter 6 provided at the end thereof abuts the cutter anvil 3 to cut the adhesive tape 9 along the line 1 to a predetermined length. The adhesive tape piece 9' thus cut stands vertically in the opening 2 in the package carrying path 1.

The portion of the adhesive side 9*a* of the adhesive tape 9' that projects above the path 1 is abutted by the front face Aa of the package A carried on the path 1 and is attached onto the front face by being pressed by the tape application roller 25 as the package A goes forward, while the rest of the adhesive tape 9' that is below the path 1 is attached on the bottom Ab of the package A as the latter moves forward. Of course, the tape application roller 25 is retracted by being pivoted below the path 1 at this time as the package A goes forward.

Namely, the adhesive tape piece 9' attached on the corner Ac of the package A has disposed at the top end thereof the non-adhesive area 9*b* formed by the paint layer portion 30 having a predetermined width. The non-adhesive area 9*b* does not adhere to the package A, so that the adhesive tape once attached to a package can easily be peeled off later. The adhesive tape itself is made of a polyethylene sheet as thin as about 20 microns and which will leave evidence of tape separation or unsealing when peeled off a package. That is to say, once peeled off, the adhesive tape itself is deformed by being elongated by a tensile force or irregularly cut, which will leave evidence of tape separation. It should be noted that the reference numeral 37 in FIG. 1 indicates a take-up reel for the foil tape 18 from which the aforementioned paint foil has been partially punched off.

As described in the foregoing, the apparatus for applying an adhesive tape to the corners of a package, according to the present invention, is disposed below a package carrying path. At a stage before the adhesive tape cutting mechanism, a foil tape having a paint foil formed thereon and which is fed out from a foil tape source disposed separately from the source of the adhesive tape is superposed on the adhesive tape at the position of a hammer anvil, and the foil tape is intermittently hit by a hammer to transfer the paint foil portions to the adhesive side of the adhesive tape, thereby forming non-adhesive areas from the paint layer portions at predetermined intervals on the adhesive tape. Thus the corners of the package carried along the path can be automatically sealed with the adhesive tape, and since the adhesive tape has formed on the top end thereof the non-adhesive area of a predetermined width (for example, 2 to 3 mm), the adhesive tape can be easily peeled off later at the time of unpacking the package. Furthermore, a protrusion formed on the bottom face of the hammer anvil and a corresponding recess formed in one side of the hammer work cooperatively to make a fold along the boundary between the adhesive and non-adhesive area of the tape when the paint foil portion is transferred to the adhesive tape, and this fold made by reforming the adhesive tape raises the lug piece (the paint layer portion superposed on the adhesive tape) which will make it easy to peel off the adhesive tape attached on the package. The non-adhesive portion thus prepared on the adhesive tape attached on the package effectively prevents the sealed package from being fraudulently unsealed or unpacked by an unauthorized person since such portion will make such person anxious about the possible disclosure of his intended fraudulent unsealing. Since the cams used in the present invention are operatively coupled with each other by means of an endless chain and a simple structure is employed, the foil pressing means, tape supplying means, etc. can positively operate with precise timing.

What is claimed is:

1. An adhesive tape applicator, comprising:

an adhesive tape supply means for supplying an adhesive tape having adhesive on one side;

a foil tape supply means for supplying a foil tape having a foil on one side;

a hammer anvil positioned below a package carrying path and a hammer positioned in opposed relation to said hammer anvil and hammer drive means for intermittently causing said hammer to strike said hammer anvil;

a tape supplying means located below the package carrying path for intermittently feeding adhesive tape from said adhesive tape supply means and foil tape from said foil tape supply means over said hammer anvil with the adhesive on said adhesive tape and the foil on said foil tape against each other for being struck by said hammer for transferring hit portions of said foil on said foil tape onto the adhesive of said adhesive tape;

a tape feeding means for feeding said adhesive tape having said foil portions thereon vertically upwardly through said package carrying path;

cutting means along a path along which adhesive tape is fed by said tape feeding means for cutting said fed tape at a boundarys between said foil portions and adhesive on said tape; and a tape application roller along said package carrying path downstream relative to the package movement direction from the position at which said adhesive tape has been fed upwardly through said package carrying path and movably mounted for movement between a tape application position in which it is above said package carrying path and a retracted position in which it is retracted below said package carrying path, said adhesive tape with a foil portion thereon projecting above said package carrying path being struck by a package moving along said package carrying path and carrying said projecting adhesive tape against said tape application roller for causing said tape application roller to roll down the front of the package and along the bottom of the package as the package passes the position of the tape application roller for rolling the adhesive tape against a corner of the package.

2. An adhesive tape applicator as claimed in claim 1 in which said hammer anvil has a face which is struck by said hammer and which has a protrusion thereon and said hammer has a face which strikes said hammer anvil and which has a recess therein at a position corresponding to the position of said protrusion when said hammer is against said hammer anvil for deforming said adhesive tape at the position of the foil portion thereon.

* * * * *